United States Patent [19]

Armstrong

[11] Patent Number: 4,779,750

[45] Date of Patent: Oct. 25, 1988

[54] BEER KEG CAP

[75] Inventor: Kenneth J. Armstrong, North Rocks, Australia

[73] Assignee: Arlco Pty. Limited, Mascot, Australia

[21] Appl. No.: 134,126

[22] Filed: Dec. 17, 1987

[30] Foreign Application Priority Data

Dec. 19, 1986 [AU] Australia ..... PH9586

[51] Int. Cl.[4] ..... B65D 41/48

[52] U.S. Cl. ..... 215/254; 215/307

[58] Field of Search ..... 215/254, 28; 220/270

[56] References Cited

U.S. PATENT DOCUMENTS 3,480,171 11/1969 Rohde ..... 215/254 X
3,785,519 1/1974 Huh ..... 215/254
3,937,349 2/1976 Hsu ..... 215/254
4,196,818 4/1980 Brownbill ..... 215/252

*Primary Examiner*—Donald F. Norton
*Attorney, Agent, or Firm*—Fitch, Even, Tabin & Flannery

[57] ABSTRACT

A removable thermoplastic cap for a beer keg bushing comprising a flat disc with integral peripheral skirt which includes inturned upwardly directed gripping lugs preventing removal of the cap when once fitted to a beer keg bushing, vertical slots spaced around the skirt and extending partway across the disc to provide venting for the interior of the bushing, and a pull tab provided on one side of the disc and connected by weakened lines to the opposite side thereof to facilitate peeling off of the cap by tearing apart the skirt.

9 Claims, 2 Drawing Sheets

BEER KEG CAP

This invention relates to beer keg caps, and more particulary to such a cap which is tamper-detectable.

It is becoming common practice to provide metal beer kegs with a closure fitting which comprises a neck, or bushing, surrounding a ball valve, for sealing of the pressurised contents, and which is selectively openable by a plunger carried upon a tap fitting secured internally to the neck by a bayonet adaptor. In order to detect whether or not the contents have been tapped, or tampered with, a plastics cap concealing the valve is clipped over the neck and cannot be removed without sustaining detectable damage. Various forms of caps have been used but in all instances drawbacks have been experienced. In some instances fractured pieces of the removed cap become jammed within the neck of valve while in others sufficient cap structure remains to permit it to be returned and attached to the neck.

A good deal of damage to kegs and their valves occurs during automatic steam cleaning if a keg is returned with a plastics cap in place. It is, therefore, important to ensure that a cap after removal is not capable of return attachment to the keg neck. It is also of advantage to ensure that a cap whilst concealing the valve permits venting of beer due to leakage of the valve.

It is the prime object of the invention to provide a beer keg cap which will satisfy at least most of the above requirements.

To this end, the invention in one general form consists of a cap for fitting to a closure neck of a beer keg to cover the dispensing valve therein, said cap comprising plastics disc, an integral apertured peripheral skirt on the disc, inturned and upwardly directed lugs about said skirt for engagement with the neck to prevent removal of said disc from the neck, a portion of said disc defined between weakened tear lines on the disc extending at least a major part of the way across the diameter of the disc and integral with a portion of said skirt, and a pull tab on said disc portion whereby when pulled the disc portion is peeled away to divide most of the disc into two parts and to provide a gap in said skirt so that the cap can be readily drawn from the neck.

The invention will be described in more detail with reference to the accompanying drawings, in which.

Figure 1:
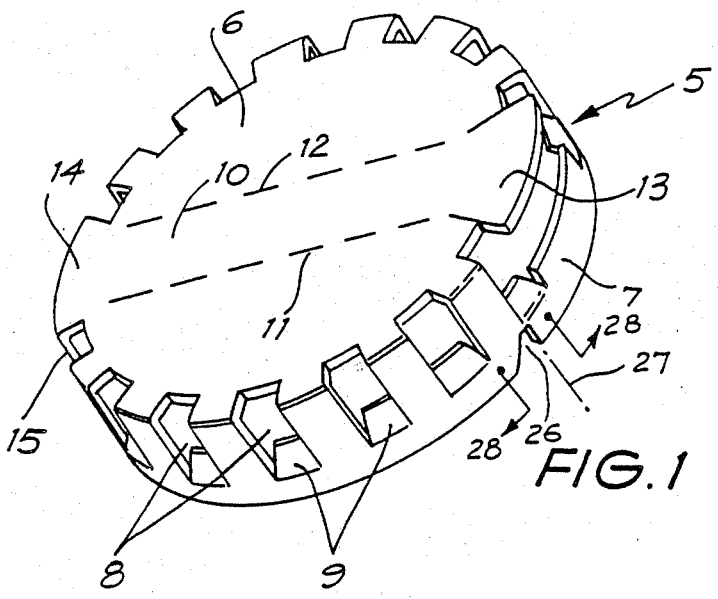
FIG. 1 is a perspective from above of a beer keg cap constructed according to this invention.
Figure 2:
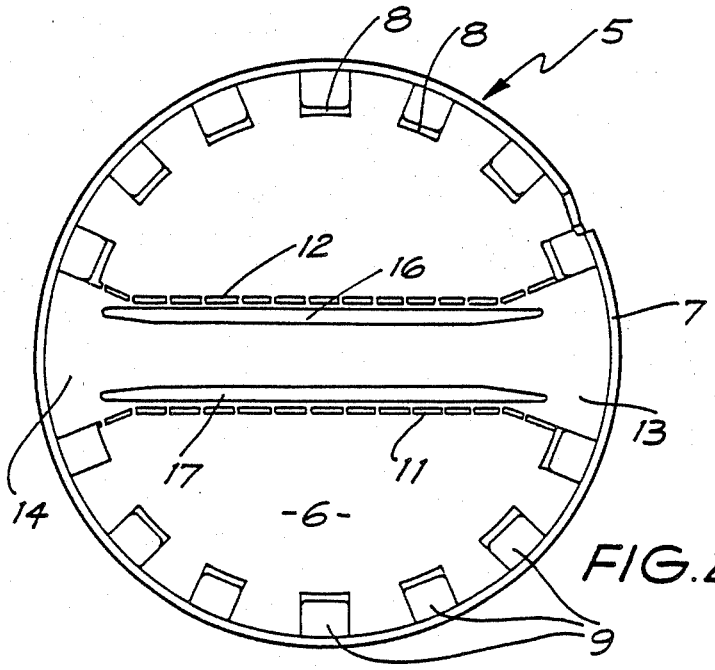
FIG. 2 is a bottom plan view thereof.

The beer keg cap 5 shown in the drawings consists of a thermoplastic shell having a circular disc top plate 6 integrally formed with a depending peripheral skirt 7. Slots 8 are provided around the periphery of the disc 6 and continue down partway into the skirt 7. Inturned and upwardly directed lugs 9 are located within the slots 8 and are integral with the skirt 7. This form of cap 5 is intended for attachment to the neck, or bushing 20, of a metal beer keg 21 to conceal a ball valve 22 within the neck 20 (see FIG. 3). The lugs 9 of the cap 5 are so constructed that when the cap 5 is pressed down over the outer end 23 of the neck 20 the lugs 9 lock beneath a terminal enlargement 24 on the neck 20 and prevent the cap 5 from being removed unless the cap is damaged, in a detectable manner, to permit removal.

Figure 3:
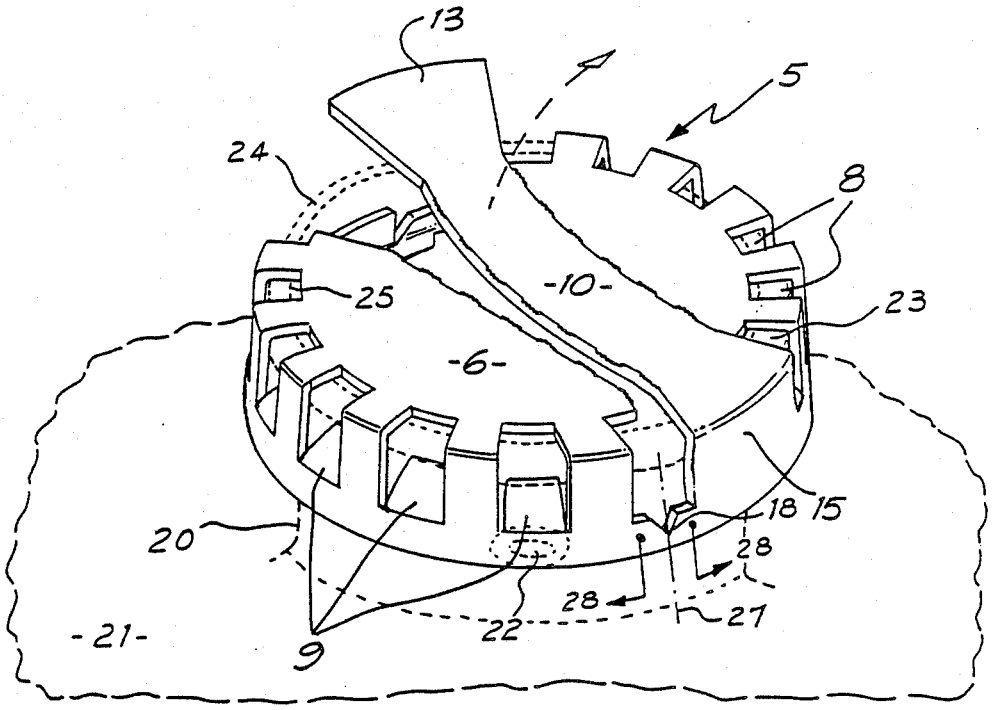
FIG. 3 is a perspective from the opposite side to FIG. 1 showing the cap being torn from a beer keg.

By the present invention a diametral portion 10, defined between weakened tear lines 11 and 12 extends wholly, or mostly, across the disc 6 to terminate at one end in a protruding pull tab 13. The opposite end 14 of the disc portion 10 is not slotted and extends downwardly to the lower extremity of the skirt 7. A weakened portion, preferably a notch 18 in the skirt 7, may, or may not, be provided to one side of this extension 15. It is designed, therefore, that a drawing force on the pull tab 13 will firstly separate the portion 10 from the disc 6 and thence will break the skirt 7 at the position of the notch 18 to one side of the extension 15 so that while remaining in a single piece the cap 5 is spread open by the pulling force and separated from the neck of the beer keg, as shown in FIG. 3. The break in the skirt 7 will invariably occur on the line 27 at the notch 18 with the resulting ends of the skirt 7 moving apart in the direction of the arrows 28. The weakened tear lines 11 and 12 may be provided by perforations or a thin connecting web between the portion 10 and the remainder of the disc 6.

It is preferred that reinforcing ribs 16 and 17 be provided in the underside of the diametral portion 10 to ensure that during pulling of the tab 13 at an acute angle back upon itself does not result in any part of the portion 10 breaking off. It will also be seen that due to the extension of the slots 8 across the disc 6 inwardly of the rim 25 of the notch 20, venting is provided via the rim 25 for the release of any liquid or fluid that might escape from the ball valve 22.

It will be seen from an understanding of the above description that a cap 5 constructed in accordance with this invention is incapable of being re-attached to the neck after having been removed. Furthermore, the removed cap 5 remains in a single piece for easy disposal. However, a further notch 26 (FIG. 1) may be included in the skirt 7 to facilitate separation of the cap 5 into two pieces if desired.

Whereas a preferred embodiment has been described in the foregoing passages it should be understood that other forms, modifications and refinements are possible within the scope of this invention.

What we claim is:

1. A cap for fitting to a closure neck of a beer keg to cover the dispensing valve therein, said cap comprising a plastics disc, an integral apertured peripheral skirt on the disc, inturned and upwardly directed lugs about said skirt for engagement with the neck to prevent removal of said disc from the neck, a portion of said disc defined between weakened tear lines on the disc extending at least a major part of the way across the diameter of the disc and integral with a portion of said skirt, and a pull tab on said disc portion whereby when pulled the disc portion is peeled away to divide most of the disc into two parts and to provide a gap in said skirt so that the cap can be readily drawn from the neck.

2. A cap according to claim 1, wherein apertures in said skirt are provided by slots spaced around the periphery of said disc and extending partway down into said skirt.

3. A cap according to claim 2, wherein said slots extend across said disc portion inwardly of the neck of the beer keg to facilitate release of escaping fluid from the dispensing valve.

4. A cap according to claim 2 or 3, wherein said lugs are integrally formed with said skirt and each of said lugs is located within a respective one of said slots.

5. A cap according to claim 3, wherein said lugs are integrally formed with said skirt and each of said lugs is located within a respective one of said slots.

6. A cap according to claim 1, wherein each of said weakened tear lines on said disc is provided by a line of perforations in said disc.

7. A cap according to claim 1, wherein reinforcing means is provided upon said disc portion.

8. A cap according to claim 1, wherein said skirt is provided with a first notch adjacent said portion of the skirt to facilitate gapping thereof in the removal of said cap from a beer keg.

9. A cap according to claim 8, wherein a second notch is provided in said skirt at a position substantially diametrically opposite said first notch.

* * * * *

UNITED STATES PATENT AND TRADEMARK OFFICE

CERTIFICATE OF CORRECTION

PATENT NO. : 4,779,750

DATED : October 25, 1988

INVENTOR(S) : Kenneth John ARMSTRONG

It is certified that error appears in the above-identified patent and that said Letters Patent is hereby corrected as shown below:

Column 1, line 18, change "of" to --or--.

Column 2, line 63, after "2" delete --or 3--.

Signed and Sealed this

Twenty-eighth Day of March, 1989

*Attest:*

DONALD J. QUIGG

*Attesting Officer*

*Commissioner of Patents and Trademarks*